US005632564A

United States Patent [19]

Chu

[11] Patent Number: 5,632,564

[45] Date of Patent: May 27, 1997

[54] WRITING IMPLEMENT

[75] Inventor: Cornel Chu, London, England

[73] Assignee: Hi-Tech Industries Limited, London, England

[21] Appl. No.: 270,255

[22] Filed: Jul. 5, 1994

[30] Foreign Application Priority Data

| | | | |
|---|---|---|---|
| Jan. 10, 1994 | [GB] | United Kingdom | 9400337 |
| Feb. 24, 1994 | [GB] | United Kingdom | 9403543 |
| Jun. 16, 1994 | [GB] | United Kingdom | 9412101 |

[51] Int. Cl.[6] ..... B43K 7/12; B43K 24/02

[52] U.S. Cl. ..... 401/104; 401/106; 401/209

[58] Field of Search ..... 401/104, 105, 401/106, 209

[56] References Cited

U.S. PATENT DOCUMENTS

| | | | |
|---|---|---|---|
| 1,527,583 | 2/1925 | Fleming . | |
| 2,494,130 | 1/1950 | Israelson . | |
| 3,637,316 | 1/1972 | Bross | 401/104 |
| 4,663,846 | 5/1987 | Takayama | 401/106 M |
| 4,706,995 | 11/1987 | Dopp . | |
| 4,717,275 | 1/1988 | Burkhardt, Jr. . | |
| 5,454,655 | 10/1995 | Chiswell | 401/106 M |

FOREIGN PATENT DOCUMENTS

| | | | |
|---|---|---|---|
| 99094 | 1/1984 | European Pat. Off. | 401/104 |
| 918242 | 2/1947 | France . | |
| 67718 | 3/1958 | France | 401/104 |
| 1351513 | 12/1963 | France | 401/104 |
| 7244435 | 1/1972 | Germany . | |
| 8516570 | 9/1985 | Germany . | |
| 8625307 | 1/1987 | Germany . | |
| 8629077 | 2/1987 | Germany . | |
| 4221700 | 8/1992 | Japan | 401/104 |
| 400826 | 4/1966 | Switzerland | 401/104 |
| 979882 | 1/1965 | United Kingdom . | |
| 2131355 | 6/1984 | United Kingdom . | |
| 83/00122 | 1/1983 | WIPO . | |
| 85/03038 | 7/1985 | WIPO . | |
| 87/04667 | 8/1987 | WIPO . | |

*Primary Examiner*—Steven A. Bratlie

*Attorney, Agent, or Firm*—Gregory F. Cotterell

[57] ABSTRACT

A writing implement having an elongate body containing a writing mechanism is disclosed. The writing implement has one end that is movable beyond an end of the elongate body, exposing a writing tip. The writing implement includes a clip which cooperates with the elongate body or a member associated with the elongate body. The clip is movable to a position abutting the elongate body or member cooperating with the elongate body. The overall thickness of the clip and adjacent elongate body or member associated with the elongate body is no greater than an overall thickness of the body of the writing implement.

15 Claims, 9 Drawing Sheets

FIG 3
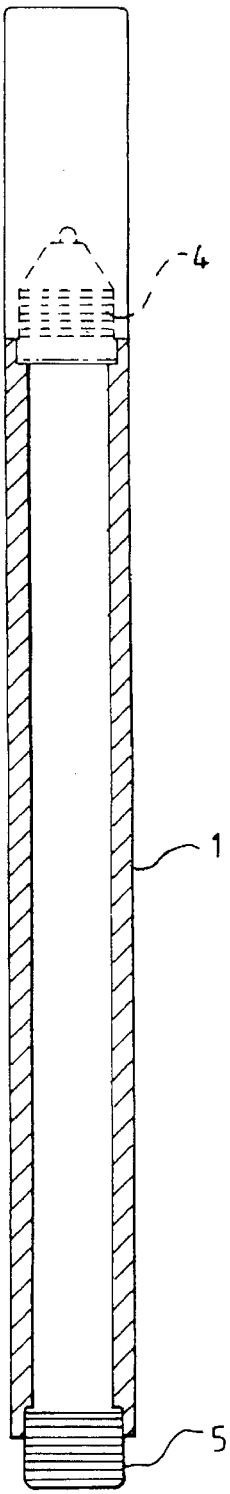
FIG 2
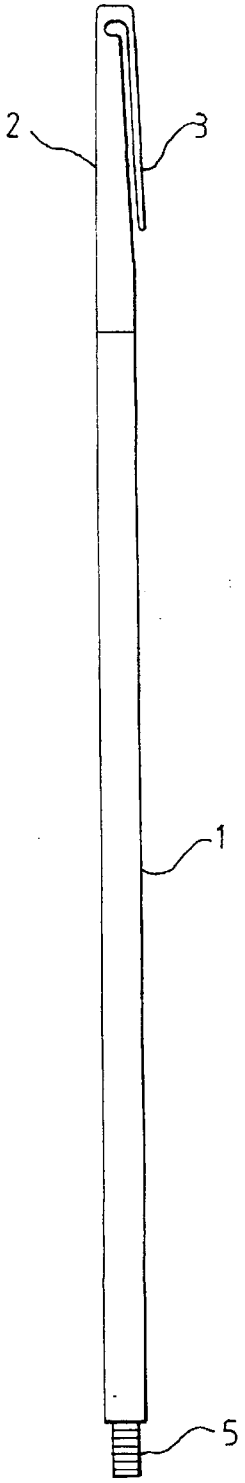
FIG 1
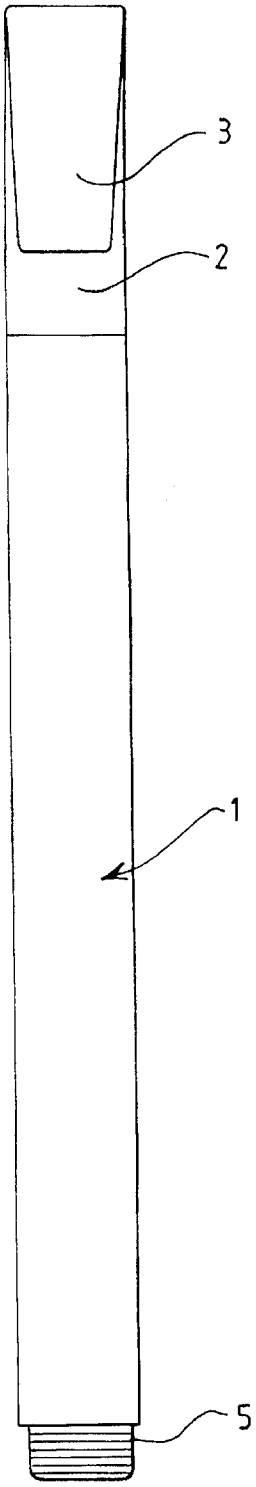
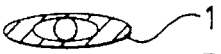
FIG 4

WRITING IMPLEMENT

BACKGROUND OF THE INVENTION

THE PRESENT INVENTION relates to a writing implement and more particularly relates to a pen or pencil.

SUMMARY OF THE INVENTION

According to this invention there is provided a writing implement comprising an elongate body containing a writing mechanism, one end of the writing mechanism being in or movable to a position in which it projects beyond one end of the elongate body to be ready for use, the elongate body, or a member associated with the elongate body carrying a clip formed integrally therewith which, respectively, co-operates with the elongate body or with part of the member, the clip being movable to a position in which it abuts the elongate body or part of the member, the combination of the body and the clip or the combination of the body, the member and clip having a thickness which does not exceed the thickness of the said body of the writing implement.

According to another aspect of this invention there is provided a writing implement comprising an elongate hollow housing, an elongate writing mechanism receivable within the housing and an actuator element connected to the writing mechanism, the actuator element having a resilient substantially arcuate portion received within the hollow housing, that arcuate portion carrying an actuator means which projects through an aperture formed in the housing, the arrangement being such that if the actuator means is depressed, the actuator element may move from a position in which the writing mechanism is extended to a position in which the writing mechanism is retracted.

In order that the invention may be more readily understood, and so that further features thereof may be appreciated, the invention will now be described, by way of example, with reference to the accompanying drawings in which:

BRIEF DESCRIPTION OF THE DRAWINGS

FIG. 1 is a front perspective view of one writing implement in accordance with the invention in the form of a pen;

FIG. 2 is a side view of the pen of FIG. 1;

FIG. 3 is a vertical section view of the pen of FIG. 1;

FIG. 4 is a horizontal section view of the pen of FIG. 1;

DETAILED DESCRIPTION OF THE PREFERRED EMBODIMENT

Figure 5:
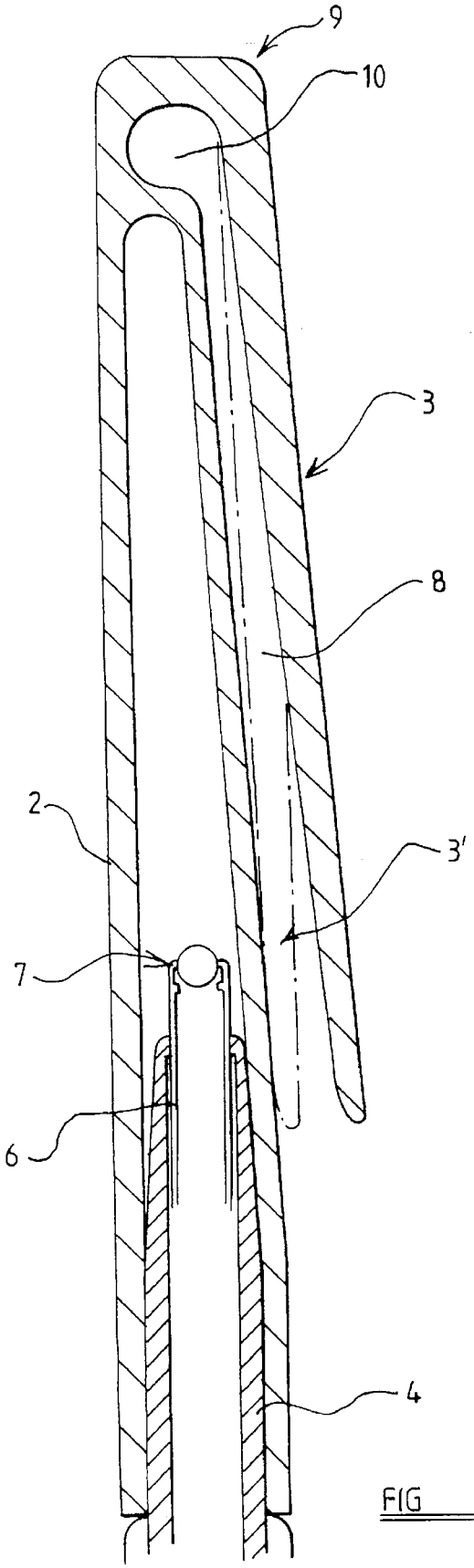
FIG. 5 is an enlarged sectional view of the cap and top part of the main body of the pen shown in FIG. 1, showing the clip in a first position in solid lines and in a second position in phantom lines.

Referring initially to FIGS. 1 to S it is to be appreciated that the illustrated pen in accordance with the invention comprises an elongate body 1 of hollow configuration which, as can be seen most clearly from FIG. 4, is of oval cross-section. The body, as will be described hereinafter in greater detail, is such that the complete pen may easily be used as a bookmark. The body of the pen typically has a width of approximately 12 mm and a thickness of approximately 4 mm.

The body is provided with a removable cap 2 which has formed therewith an integral clip 3. The cap 2 is adapted to snap-fit either on a projection 4 provided at one end of the main body 1 or on a projection 5 provided at the other end of the main body 1. The projections are of the same size and are adapted to be received as a friction fit within the open mouth formed at one end of the cap 2.

The projection 4, as can be seen most clearly in FIG. 5, is a hollow projection and supports an ink reservoir 6 which is associated with a nib assembly incorporating a ball 7, the pen thus comprising a ball point pen. The ball effectively projects beyond one end of the elongate body to be ready for use.

As illustrated in FIGS. 1, 2 and 5 the cap may be located on the projection 4 to protect the ball 7, but when in use the cap may be removed from the projection 4 and may be mounted on the projection 5.

The clip 3 that is formed integrally with the cap 2 adopts an initial position in which a space 8 is defined between the clip and an outer part of the cap. The clip comprises an elongate element which extends up to the very top region 9 of the cap where the clip is formed integrally with the rest of the cap. The substantially uniform space 8 between the clip 3 and the rest of the cap 2 terminates in a substantially circular enlargement 10 adjacent the very end of the cap. The space 8 is adapted to receive, for example, part of a pocket if the pen is to be inserted in such a pocket or may, as will be described hereinafter with reference to FIG. 6, receive one or more pages of a book.

It is to be observed that the clip 3 is a resilient clip, the resilience being provided primarily by the relative thinness of the material surrounding the circular enlargement 10 of the space 8. The clip may thus be pressed into the position 3' shown in phantom in FIG. 5, with the clip thus contacting the exterior of the main part of the cap 2, thus closing the space 8. When the clip is in this position the overall thickness of the cap and the clip is no greater than the thickness of any of the remaining parts of the pen. Thus the clip does not jut out beyond the outer periphery of the main body of the pen.

The thickness of the material between the circular enlargement 10 of the space 8 and the very end of the cap is of the same order of magnitude as the thickness of the material forming the end of the clip 3 adjacent the enlargement 10. Preferably the thickness of the material at the end of the cap is no greater than the thickness of the end part of the clip.

Figure 6:
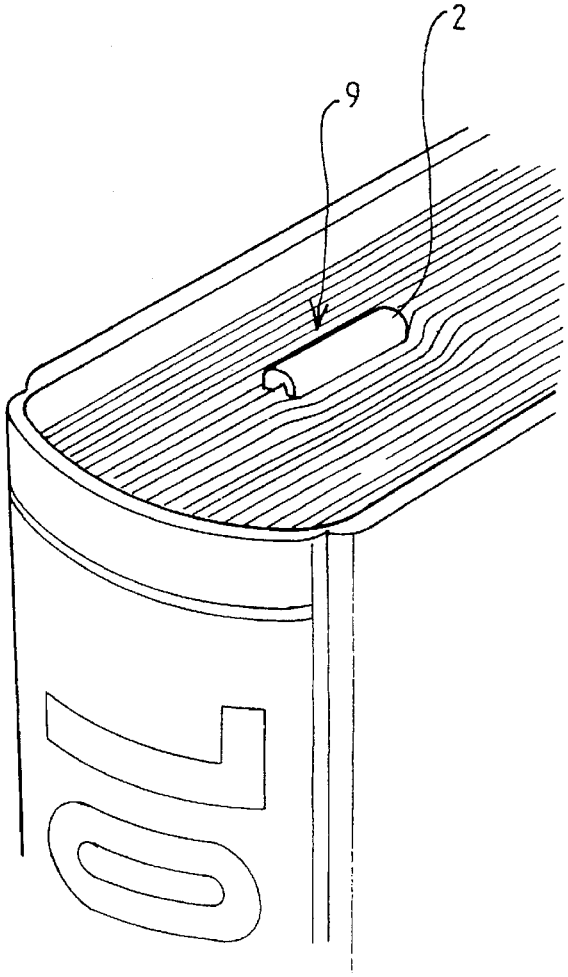
FIG. 6 shows the pen of FIGS. 1 to 5 in use as a bookmark.

Referring now to FIG. 6 it is to be observed that the pen as illustrated in FIGS. 1 to 5 may be utilized as a bookmark. The pen may be slid between two open pages of a book, and one or more pages are introduced into the gap 8 between the clip 3 and the main body of the pen. When the book is closed, because the pen is relatively thin in the transverse direction (in the described example having a thickness of 4 mm) the pen does not distort the book significantly. Also, since the clip provided on the cap may move resiliently inwardly to a position in which the total thickness of the cap and the clip does not exceed the thickness of the body of the pen, the presence of the clip will not distort the book to a greater extent than the distortion provided by the presence of the pen.

Because of the thickness of the material at the end of the cap, the pen can be accommodated almost entirely within the book, with only a very small terminal part of the cap protruding.

Whilst FIG. 1 has made reference to a writing implement in the form of a pen it is to be appreciated that the writing implement may be in the form of a pencil. The projection 5 might, in such an embodiment, comprise a depressible projection which can be depressed to actuate a propelling pencil mechanism within the main body of the pen.

Whilst in the embodiment of FIGS. 1 to 5 the clip is formed integrally with a cap for the pen, it is to be appreciated that in alternative embodiments the clip may be formed on the main body of the pen. Such an embodiment is illustrated in FIGS. 7 to 12 of the accompanying drawings.

Figure 7:
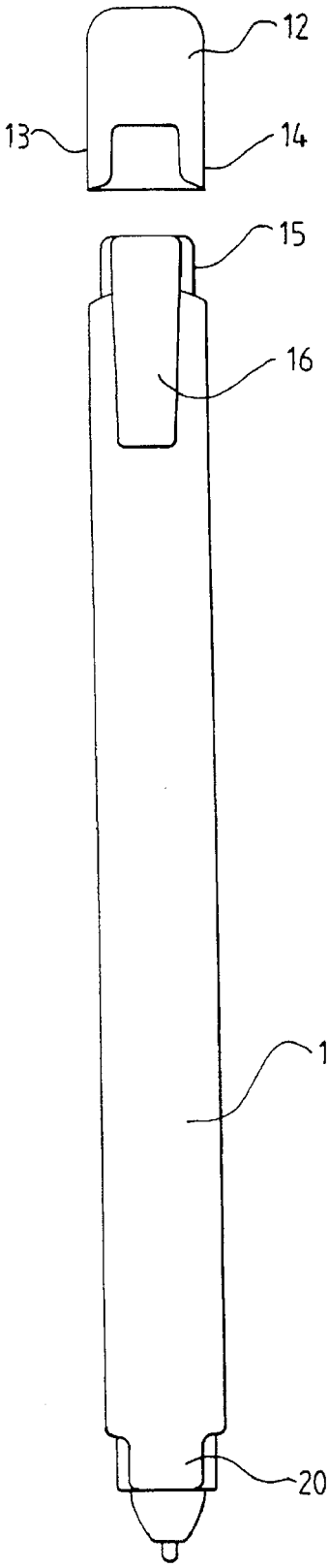
FIG. 7 is a front view of an alternative form of writing implement in accordance with the invention comprising a pen with a cap exploded away from the main part of the pen.
Figure 8:
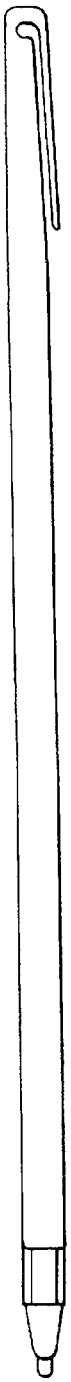
FIG. 8 is a side elevation view of the main part of the pen of FIG. 7.
Figure 9:
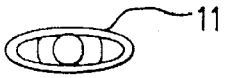
FIG. 9 is a cross-sectional view of the main part of the pen of FIG. 7.

Referring now to FIGS. 7 to 12 of the accompanying drawings, a pen is illustrated having a main body 11 which is, as can be seen from FIG. 9, of oval cross-section. The pen may have a width of approximately 12 mm and a thickness of approximately 4 mm.

The main body of the pen is associated with a cap 12 having an oval cross-section similar to that of the main body 11 of the pen, the cap 12 having a downwardly open mouth in the position illustrated in FIG. 7, and having two downwardly extending hollow projections 13, 14 located respectively at the apices of the oval cross-section of the cap. The cap is adapted to engage a projection 15 provided at the upper end of the main body 11 of the pen as shown in FIG. 7, that projection having a cross-section slightly smaller than the cross-section of the main body 15, the projection carrying, towards its forward edge, a clip 16 which operates with the rest of the main body of the pen.

It is to be observed that when the cap 12 is located in position on the main body 11 of the pen the projections 13 and 14 extend to either side of the clip 16, snugly engaging the clip 16 in the space defined between the projections 13 and 14.

Figure 11:
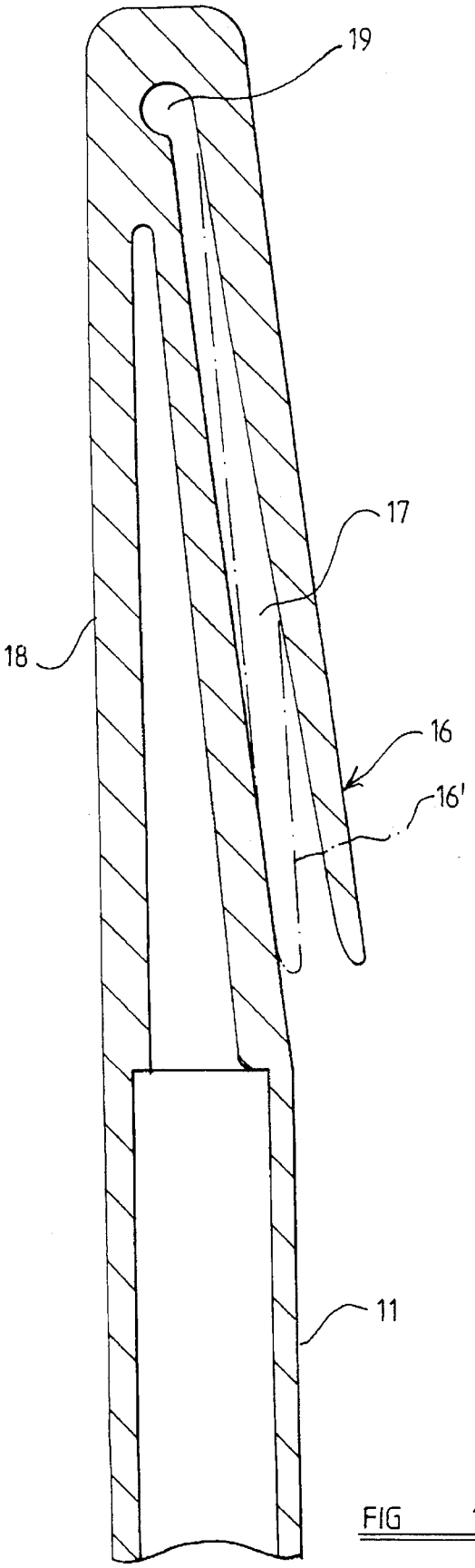
FIG. 11 is an enlarged sectional view of the main part of the body of the pen of FIG. 7 which carries the clip, showing the clip in a first position in solid lines and in a second position in phantom lines.
Figure 12:
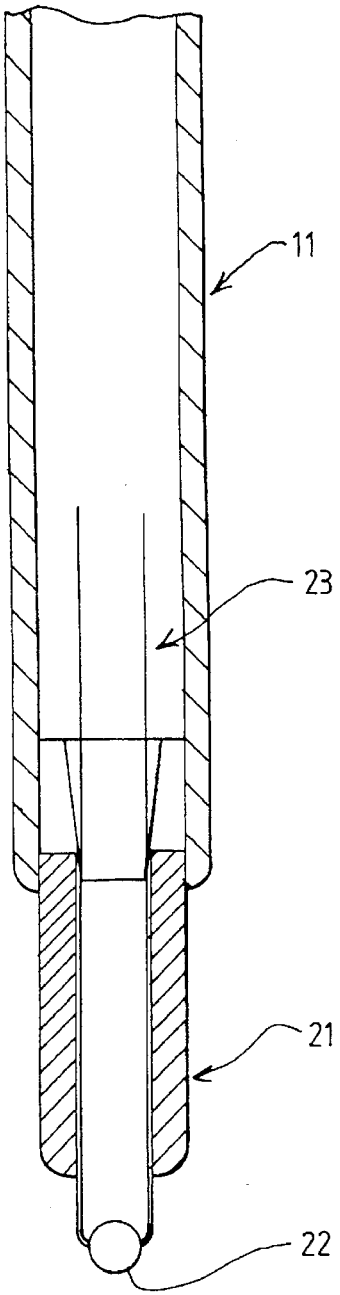
FIG. 12 is an enlarged sectional view of the opposite end of the main body of the pen of FIG. 7.

The, clip 16, as can be seen more clearly from FIG. 11, is formed integrally with the main body 11 of the pen. The clip is of elongate form and defines a substantially parallel sided space 17 between the inner face of the clip 16 and an outer face of the terminal portion 18 of the main body 11 of the pen. The space 17 terminates with a substantially circular enlargement 19. The thickness of the material between the circular enlargement 19 and the end of the pen is substantially equal to the thickness of the material forming the end of the clip 16 adjacent the circular enlargement 19. The clip is of resilient nature and may be moved to the position illustrated in phantom at 16', with the main part of the clip 16 urged into contact with at least part of the terminal portion 18 of the main body 11 of the pen, thus closing the space 17. When the clip is in the position in which it is in contact with the terminal portion 18 of the pen the resilience of the clip is provided primarily by the relative thickness of the material surrounding the circular enlargement 19 of the space 17 the total thickness of the terminal portion 18 of the main body 11 of the pen and the clip 16 does not exceed the dimensions of the main body 11 of the pen.

At the opposite end of the pen to the projection 15 there is a similarly dimensioned projection 20 the interior of which is adapted to receive a moulding which retains the ball assembly 22 of a ball point pen mechanism which includes an ink reservoir 23 which is received within the hollow interior of the main body 11 of the pen. The moulding 21 is a friction fit within the open end of the main body ii of the pen. The ball assembly 22 projects beyond one end of the main body 11 of the pen to be ready for use.

The projection 20 has the same external configuration as the projection 15 and thus the cap 12, if inverted, may be mounted on the projection 20.

The pen of FIGS. 7 to 12 may also be used as a bookmark, in the manner of the pen of FIGS. 1 to 5.

Figure 13:
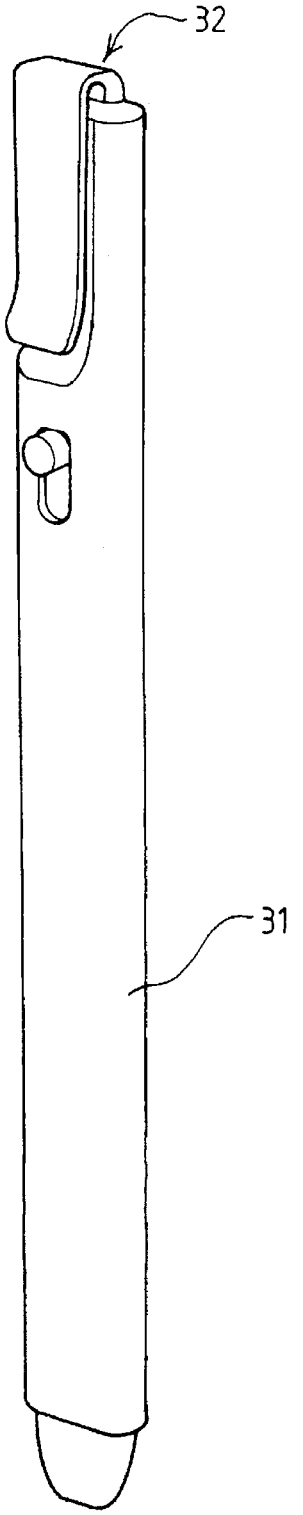
FIG. 13 is a perspective view of another writing implement in accordance with the invention, comprising a ball point pen, with the writing implement in a "retracted" position.
Figure 14:
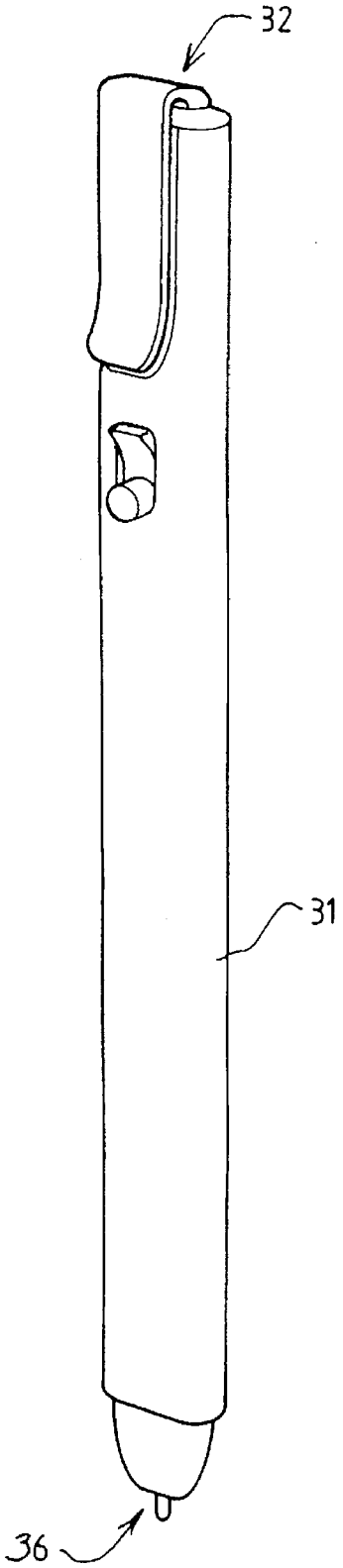
FIG. 14 is a perspective view corresponding to FIG. 13 showing the writing implement in the operative position.

As can be seen from FIGS. 13 and 14, the writing implement comprises a main housing 31 of generally cylindrical form having, at the upper end, a projecting clip member 32. As will be described in greater detail hereinafter, the design of the writing implement is such that the clip member may be pressed to move the writing mechanism of the writing implement from an inoperative or retracted position to an operative or protruding position, and vice-versa. Thus, the clip member can be considered to act as an actuator element.

Figure 15:
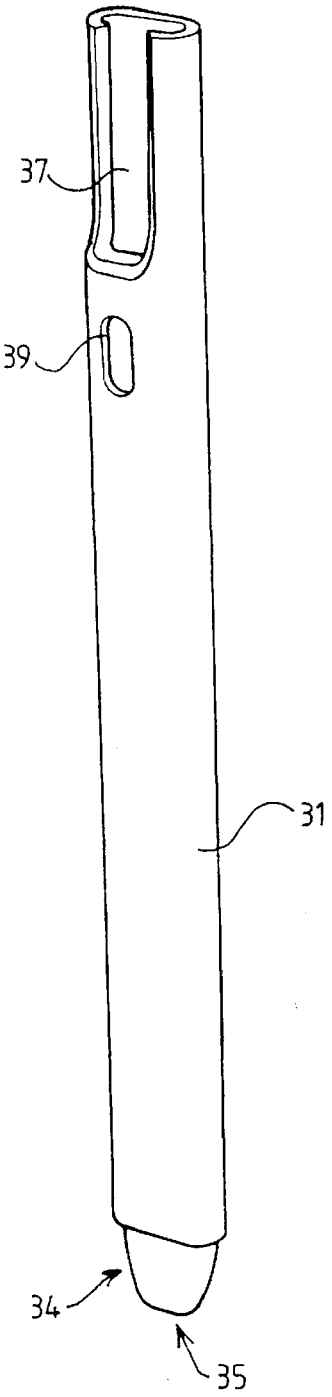
FIG. 15 is a perspective view of the outer body of the writing implement of FIGS. 13 and 14.
Figure 16:
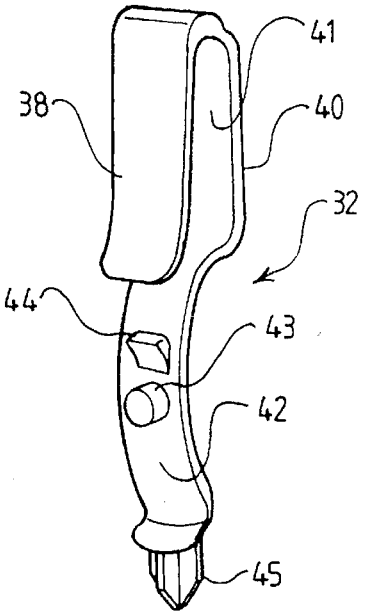
FIG. 16 is a perspective view of a clip and actuating element forming part of a pen of FIGS. 13 and 14.
Figure 17:
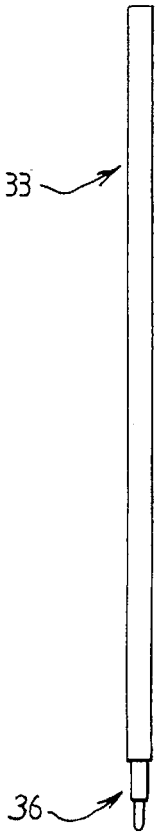
FIG. 17 is a perspective view of a standard refill for use in the writing implement of FIGS. 13 and 14.

As can be seen more clearly from FIGS. 15 to 17 the writing implement of the invention being described comprises simply three components, namely an elongate housing 1 as shown in FIG. 15, a clip member 32 as illustrated in FIG. 16, and a standard ball point refill 33 as illustrated in FIG. 17.

The housing 31 shown in FIG. 15 is of a generally oval cross-section, but the lower part 34 of the housing is provided with a generally pointed end having an axially extending aperture 35 through which the ball point 36 of the refill 33 may project when the pen is in the condition illustrated in FIG. 14.

Figure 18:
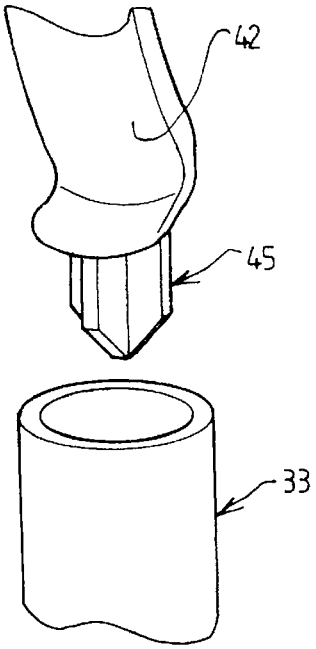
FIG. 18 is an enlarged partial view illustrating how the clip of FIG. 16 is connected to the refill of FIG. 17.

The upper end of the housing 31 is provided with a recess 37 adapted to receive a clip part 38 of the clip member 32, and also with an elongate aperture 39 located beneath the recess 37 adapted to receive an actuator button 40 forming part of the clip member 32. The clip member 32 comprises a substantially elongate plastic element having, at an upper end, a clip part 38 spaced slightly from a main body 40 of the clip member by means of a gap 41. The main body of the clip member continues with an arcuate resiliently deformable portion 42 which carries a actuating button 43 and an engagement lip 44 as will be described hereinafter and which terminates in a lower end carrying a cruciform cross-sectioned stake 45 extending downwardly and being intended to be received as a friction fit within the open end of the standard refill, as can be seen most clearly from FIG. 18. The clip member 32 is thus connected to the standard refill 33.

It is to be appreciated that the pen is fabricated by inserting the stake 45 provided on the clip member 32 into the open end of the refill 33, and then inserting the refill through the top of the housing 31 until the clip part 38 is aligned with the recess 37.

The clip member 32 may be moulded of a number of polymeric materials. As the clip member is introduced into the main body of the pen, the arcuate portion 42 is substantially straightened. As the clip member continues to be inserted into the main body of the pen, the arcuate portion is further deformed to permit the actuating button 43 and the lip 44 to move past the bottom of the recess 37 so that the actuating button 43 and the lip 44 may slide fully into the body of the pen. Due to the resilience of the arcuate portion 42 of the clip member 32 as it is slid into the pen, it will occupy the condition illustrated in FIG. 20 where the actuating button 43 is located at the bottom of the aperture 39 formed in the main body of the pen and the lip 44 is also engaged in aperture 39 engaging the upper portion of the aperture 39. Since the arcuate portion 42 is deformed as compared with its original condition before being inserted in, the natural resistance of the arcuate portion 42 ensures that parts of the arcuate portion 42 are always resiliently biased into contact with the interior of the main body 31 of the pen.

Figure 19:
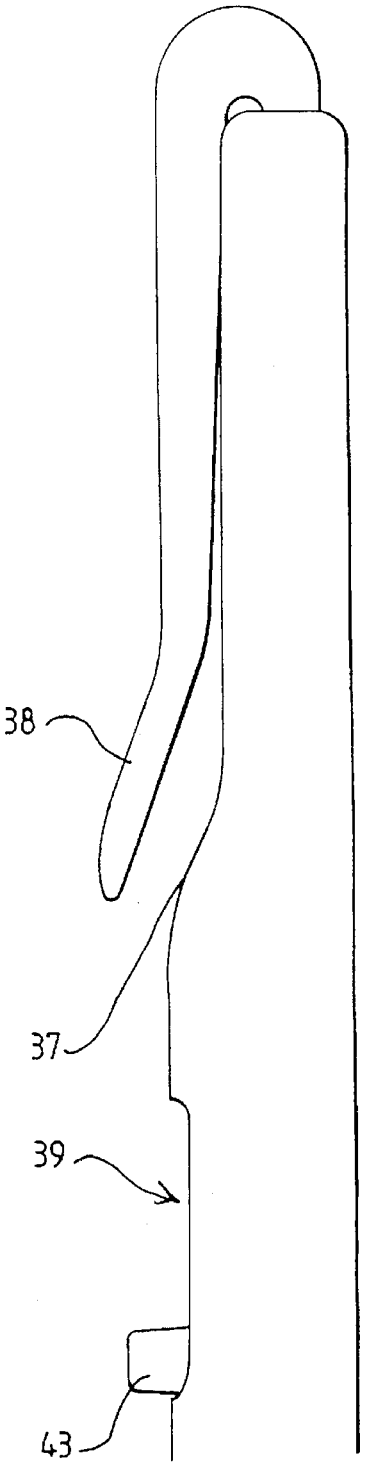
FIG. 19 is a side top view of the writing implement when in the operative position.
Figure 22:
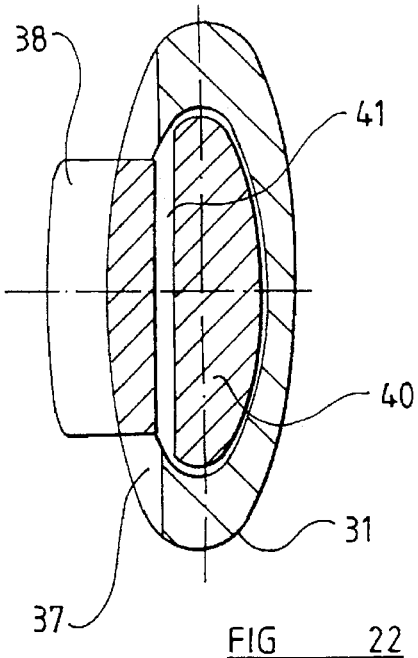
FIG. 22 is a sectional view taken on line X—X of FIG. 21.
Figure 20:
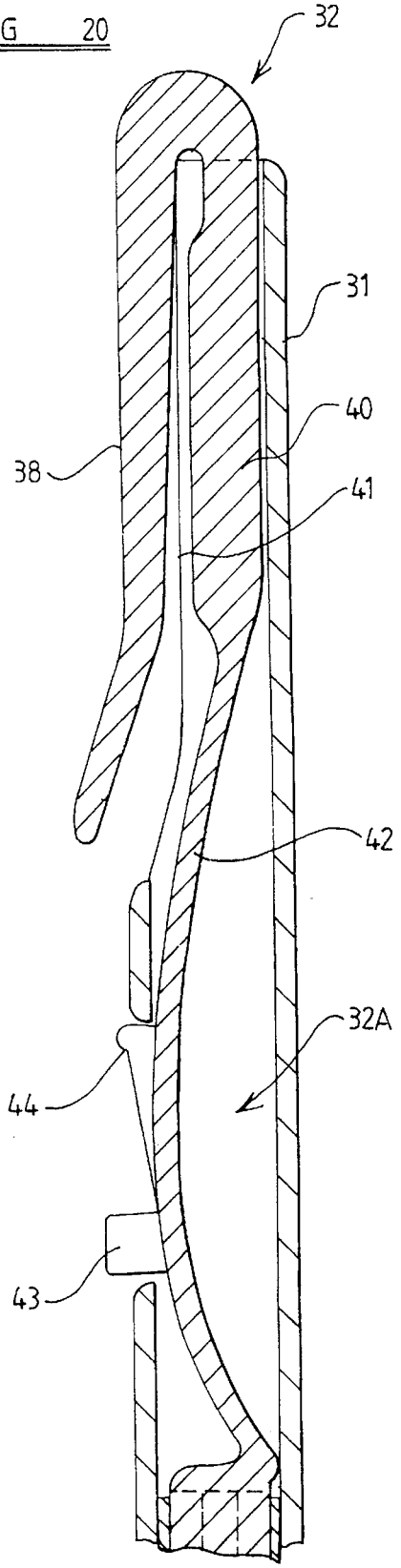
FIG. 20 is a sectional view of the top part of the pen, illustrating the pen in the operative position.

This is the condition of the pen illustrated in FIGS. 14, 19 and 20. When in this condition, the pen may be utilized since the ball point portion 36 of the standard refill 33 will project through the axially extending aperture 35 provided at the bottom of the main body 31 of the pen.

When the ball point portion 36 is to be moved to the retracted condition, the actuator button 43 is pressed inwards against the bias provided by the arcuate portion 42 of the clip member 32 which serves to disengage the lip 44 from the aperture 39, and the actuator button 43 is then pushed upwardly relative to the body 31 of the pen. Provided that the actuator button 43 is pressed inwardly sufficiently for the lip 44 to be fully disengaged from the periphery of the aperture 39 formed in the body 31 of the pen, the clip member 32 will move smoothly upwardly, thus retracting the ball point portion 36 of the standard refill 33. The outward bias provided by the arcuate portion 42 provides an upward force which serves to assist the retraction of the writing mechanism into the housing 31. Thus, there is no need for a separate compression spring, as often found in retracting writing implements.

Figure 21:
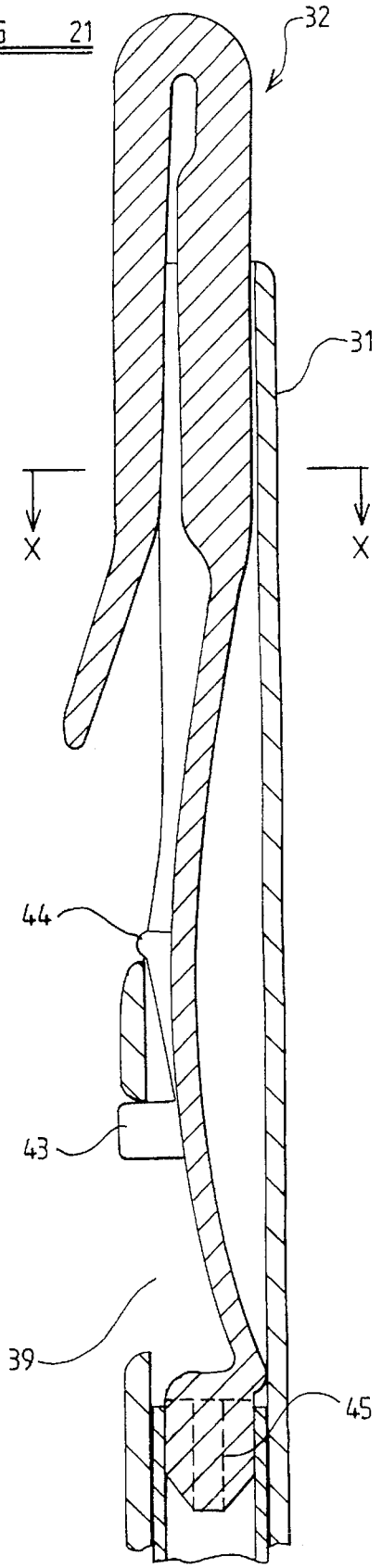
FIG. 21 is a view corresponding to FIG. 20 showing the pen in the retracted position.

If, once the clip member 32 is moving, the inward pressure applied to the actuator button 43 is released, the actuator button 43 will be biased outwardly and will engage the upper periphery of the aperture 39, as shown in FIG. 21, when the refill 33 is fully retracted.

The pen may then be clipped in a pocket or in a book. It is to be observed that although the clip portion 38 of the clip member 32 is separated from the main body 40 by a gap 41, if an inward pressure is provided to the terminal portion of the clip, that gap 41 will close, with the clip part 38 then abutting against the main body 40 of the clip member 32 and retractor element. When in this condition the free end of the clip part 38 does not project beyond the envelope defined by the main body 31 of the pen. Thus, the pen may be used, for example, as a bookmark, bearing in mind the oval nature of the cross-section of the pen.

When the pen is again to be brought to the operative state, a downward pressure is applied to the top of the clip member 32, which causes the terminal portion of the lip 44 to ride past the lower edge of the recess 37 formed in the top of the main body 31 of the pen, so that continued downward movement of the clip member 32 returns the pen to the operative position as illustrated in FIGS. 14, 19 and 20.

Also, while in the embodiment of FIGS. 13 to 22 an actuator button 43 on the arcuate portion 42 of the clip member 32 extends through the aperture 39 in the main body 31, the button may be omitted, with part of the surface of the arcuate portion 42 of the clip member 32 being accessible through the aperture 39. Manual pressure may then be applied directly to the arcuate portion 42 to operate the pen.

Figure 10:
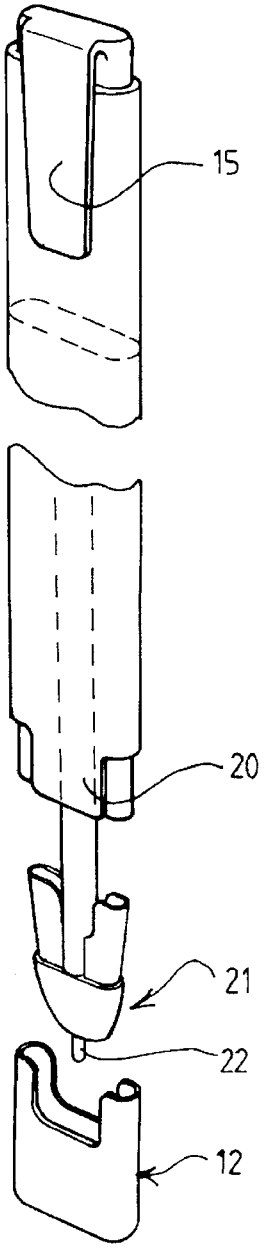
FIG. 10 is a perspective exploded view showing the pen and cap of FIG. 7.

Whilst the invention has been described above with specific reference to a ball point pen, and whilst reference has been made to an embodiment in the form of a pencil, reference will now be made to FIGS. 23 to 25 which illustrate an embodiment broadly similar to that of FIGS. 8 to 10 but in the form of a fibre-tipped pen.

Figure 23:
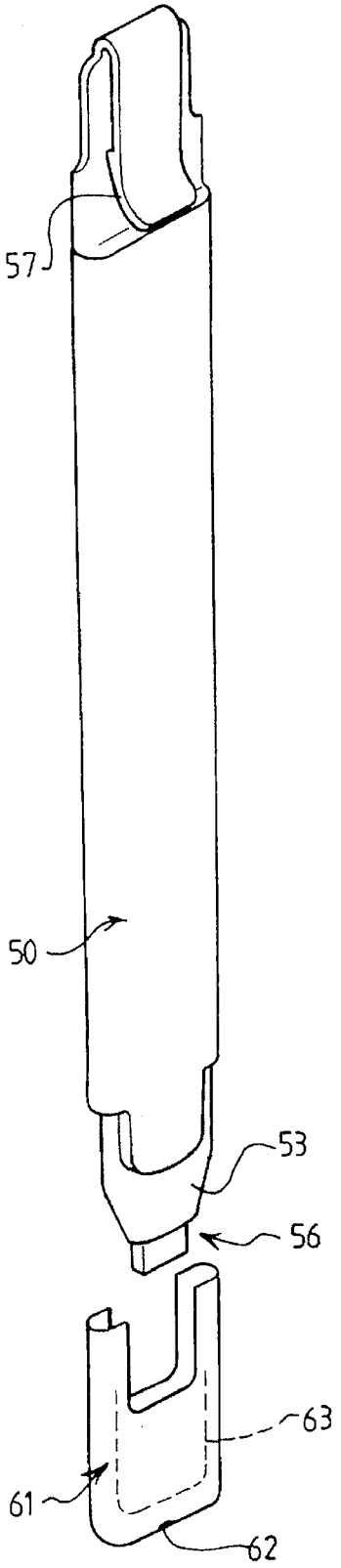
FIG. 23 is an exploded view of another embodiment of a writing implement in accordance with the invention, with a cap.
Figure 24:
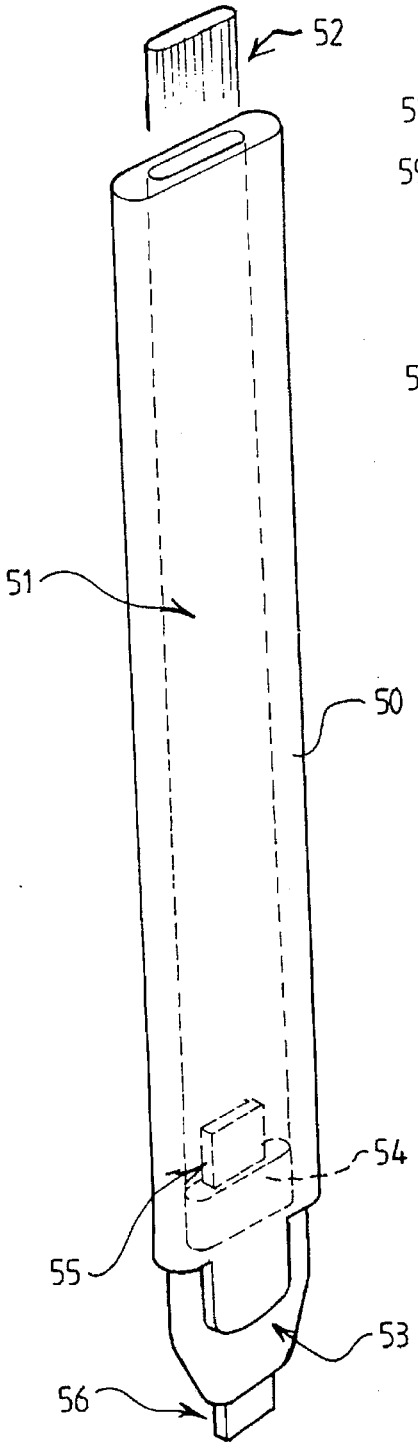
FIG. 24 is a view, partly in phantom, of the main part of the writing implement of FIG. 23 and, FIG. 25 is a side view of the writing implement of FIG. 23 without the cap.
Figure 25:
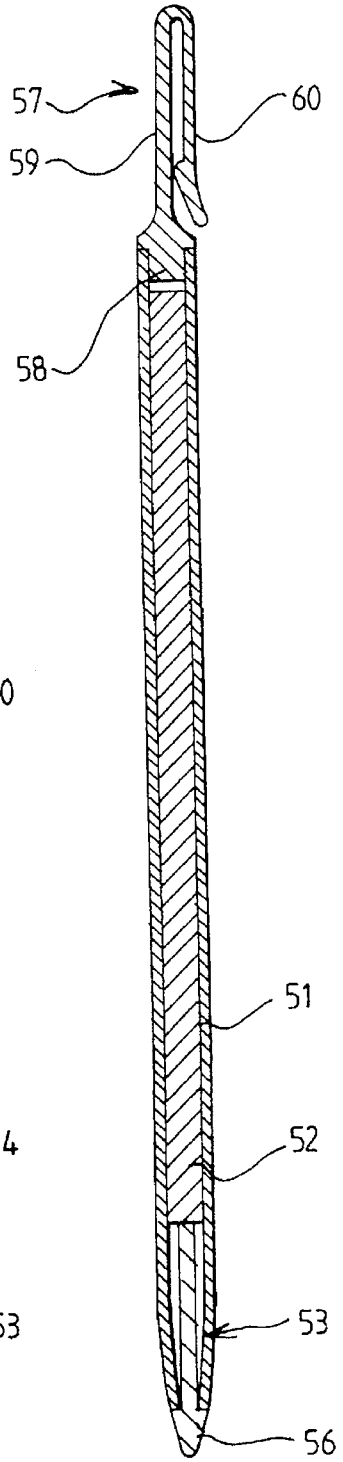

Referring to FIGS. 23 to 25, a further embodiment of a writing implement in accordance with the invention comprises an elongate body 50 which is, as in the previous embodiments, of oval external cross-section. The body 50 defines an axially extending passage 51. The body 50 may be formed through the process of injection moulding or as an extrusion which is then cut to length.

The passage 51 contains a fibrous ink cartridge 52 which acts as a reservoir of ink for the described writing implement.

At the lower end of the body 50, a tip holder 53 is provided which is an injection moulded element having a spigot 54 which is received as a friction fit within the lower end of the passage 51. The tip holder 53, has extending through it, a fibrous or felt-tip having a protruding upper end 55 which is in contact with the cartridge 52 within the passage 51, and a projecting lower end 56 which forms the writing tip for the implement.

Received within the upper end of the body 50 is a clip element 57 formed as an integrally moulded element having a spigot 58 adapted to be received as a friction fit within the upper end of the passage 51 and having a main body portion 59 which carries a clip portion 60 adapted to co-operate with the main body portion 59. As can be seen, when the clip is in a retracted or pressed in position, the total width of the main body portion 59 and the clip 60 does not extend beyond the envelope of the body 50, thus the thickness of the main body portion 59 and the clip 60 does not exceed the thickness of the body 50 of the writing implement.

A cap 61 is provided, as shown in FIG. 23. The cap 61 may be formed through a process of moulding and is adapted to be received either on the tip holder 53 or on the clip 57 provided at the other end of the main body. It is to be noted that the cap 61 of the embodiment of FIGS. 23 to 25 is similar in overall appearance to the cap 12 of the embodiment of FIGS. 8 to 10, the cap 61 having an open mouth and two extending hollow projections located at the apices of the overall cross-section of the cap. The cap 61 may be provided with a vent hole 62 but may include, within the cap a substantially air-tight pocket or recess 63 adapted to receive and seal the tip 56 of the fibre-tipped writing mechanism incorporated in the writing implement being described.

What is claimed is:

1. A writing implement comprising:

an elongate body, the body having a length, a width, a thickness, a first end and a second end, wherein the width exceeds the thickness and further comprising an axially disposed bore extending along the length of the elongate body;

a writing mechanism, one end of the writing mechanism movable to a position wherein a first end of the writing mechanism projects beyond the second end of the elongate body; and a clip, having a first leg and a second leg connected at an end of each leg with a curved portion, the first leg operably connected with the first end and co-operates with the elongate body and the second leg is proximate a side of the elongate body, the clip being movable between a first position in which the second leg abuts a portion of the elongate body and a second position, wherein the combination of a thickness of the body adjacent the clip and a thickness of the second leg has a combined thickness which does not exceed the thickness of a remaining portion of the elongate body.

2. The writing implement according to claim 1 wherein the clip in the second position is spaced apart from the elongate body and defines a space between the second leg and the elongate body, said space terminating at the curved portion, the curved portion being relatively thin to provide the clip with flexible resilience.

3. The writing implement according to claim 2 wherein a thickness of the second leg is of the same order of magnitude as a thickness of the curved portion of the clip.

4. The writing implement according to claim 1 further comprising a retractor mechanism integrally connected to the first leg, the retractor mechanism including an integrally formed lip and an actuator element, wherein the retractor mechanism retracts the writing mechanism into said body.

5. A writing implement according to claim 1 wherein the writing mechanism is a ball point mechanism.

6. A writing implement according to claim 1 wherein the elongate body is of substantially oval cross-sectional shape.

7. A writing implement according to claim 6 wherein the elongate body has a width of approximately 12 mm and a thickness of approximately 4 mm.

8. A writing implement comprising an elongate hollow housing with a first end and a second end along the housing's long axis, the housing having a substantially wider dimension relative to its overall thickness and with an aperture in the housing's side proximate the first end, an elongate writing mechanism receivable within the housing along the long axis of the housing and at least partially operably extendible out a port at the housing second end, and an actuator element connected to the writing mechanism operably slidably connected to the elongate hollow housing, the actuator element having a resilient substantially arcuate portion slidably received within the hollow housing and a clip portion extending from the hollow housing at the first end, the clip portion curving back along the long axis of the housing with the housing and clip portion having a combined thickness no greater than the overall thickness, the arcuate portion carrying an actuator arm which projects through the aperture, such that depressing the actuator arm moves the actuator element along the long axis of the housing from a first position in which the writing mechanism is operably extended to a second position in which the writing mechanism is retracted.

9. A writing implement according to claim 8 wherein the writing mechanism comprises a standard ball point refill.

10. A writing mechanism according to claim 9 wherein the standard ball point refill is connected to the actuator element by means of a stake formed integrally with the actuator element inserted into the open end of the standard refill.

11. A writing implement according to claim 10 wherein the stake is of cruciform cross-sectional shape.

12. The writing implement according to claim 8 wherein the arcuate portion is deformed as it is initially inserted into the body of the pen so that parts of the arcuate portion are always resiliently biased into contact with the interior of the elongate hollow housing.

13. The writing implement according to claim 12 wherein the arcuate portion, when within the interior of the elongate hollow housing, biases the writing mechanism to the retracted position.

14. The writing implement according to claim 8 wherein the actuator element includes a projecting lip, the lip being adapted to engage an edge of the aperture when the writing mechanism is extended.

15. The writing implement, according to claim 8 wherein the clip portion is spaced from the arcuate portion, the clip portion being moveable into contact with the arcuate portion and when in this position, the clip portion does not extend beyond an envelope defined by the housing of the writing implement.

* * * * *